US006408837B1

(12) United States Patent
Johnson et al.

(10) Patent No.: US 6,408,837 B1
(45) Date of Patent: Jun. 25, 2002

(54) TOY GUN WITH MAGAZINE

(75) Inventors: Lonnie G. Johnson, Atlanta; John T. Applewhite, Smyrna; Jeffrey Shane Matthews, Milner, all of GA (US)

(73) Assignee: Johnson Research & Development Co., Smyrna, GA (US)

( * ) Notice: Subject to any disclaimer, the term of this patent is extended or adjusted under 35 U.S.C. 154(b) by 0 days.

(21) Appl. No.: 09/395,279

(22) Filed: Sep. 13, 1999

(51) Int. Cl.[7] ..... F41F 1/00
(52) U.S. Cl. ..... 124/51.1; 124/65
(58) Field of Search ..... 124/65, 51.1, 82, 124/16, 1, 49; 473/451; 273/201; 89/33

(56) References Cited

U.S. PATENT DOCUMENTS

| | | | | |
|---|---|---|---|---|
| 1,713,432 | A | 5/1929 | Griggs | |
| 2,023,124 | A | 12/1935 | Dickover | 46/86 |
| 2,147,003 | A | 2/1939 | Von Kozurik | 124/11 |
| 2,312,244 | A | 2/1943 | Feltman | 124/11 |
| 2,357,951 | A | 9/1944 | Hale | 124/11 |
| 2,409,653 | A | 10/1946 | Amdur | 124/11 |
| 2,505,428 | A | 4/1950 | Pope | 124/11 |
| 2,654,973 | A | 10/1953 | Lemelson | 46/56 |
| 2,733,699 | A | 2/1956 | Krinsky | 124/13 |
| 2,927,398 | A | 3/1960 | Kaye et al. | 46/74 |
| 3,025,633 | A | 3/1962 | Kaye et al. | 46/74 |
| 3,049,832 | A | 8/1962 | Joffe | 46/74 |
| 3,121,292 | A | 2/1964 | Butler et al. | 46/74 |
| 3,218,755 | A | 11/1965 | Quercetti | 46/86 |
| 3,308,803 | A | 3/1967 | Walther | 124/13 |
| 3,397,476 | A | 8/1968 | Weber | 43/6 |
| 3,415,010 | A | 12/1968 | Belz | 46/241 |
| 3,510,980 | A | 5/1970 | Pippin, Jr. | 46/74 |
| 3,878,827 | A * | 4/1975 | Newgarden, Jr. | |
| 3,943,656 | A | 3/1976 | Green | 46/74 |
| 3,962,818 | A | 6/1976 | Pippin | 46/74 |
| 4,004,566 | A | 1/1977 | Fischer | 124/11 |

(List continued on next page.)

FOREIGN PATENT DOCUMENTS

| | | | |
|---|---|---|---|
| EP | 0054089 A1 * | 6/1982 | |
| FR | 2587911 A1 | 10/1985 | |
| GB | 2082295 A * | 3/1982 | |

*Primary Examiner*—Michael J. Carone
*Assistant Examiner*—Troy Chambers
(74) *Attorney, Agent, or Firm*—Baker, Donelson, Bearman & Caldwell

(57) ABSTRACT

An air compressed gun (10) is provided having a stock (11), a launch tube (12), a magazine (18), a manual air pump (14) and a loading tube (29). The magazine has an outer shell (25) and an indexing wheel mounted (26) mounted within the outer shell. The indexing wheel has a central hub (31), a peripheral ring (35) and an annular array of fins (32) extending between the central hub and peripheral ring which define an annular array of projectile cells (34).

18 Claims, 4 Drawing Sheets

U.S. PATENT DOCUMENTS 4,073,280 A 2/1978 Koehn ..... 124/72
4,083,349 A 4/1978 Clifford ..... 124/72
4,138,923 A * 2/1979 Brosseau et al.
4,159,705 A 7/1979 Jacoby ..... 124/63
4,223,472 A 9/1980 Feket et al. ..... 46/44
4,411,249 A 10/1983 Fogarty et al. ..... 124/64
4,413,546 A * 11/1983 Taylor, Jr.
4,454,971 A * 6/1984 Poehlmann
4,466,213 A 8/1984 Alberico et al. ..... 446/56
4,487,103 A * 12/1984 Atchisson
4,687,455 A 8/1987 Sculatti ..... 446/52
4,817,955 A * 4/1989 Hickson et al.
4,819,609 A 4/1989 Tippmann ..... 124/72
4,848,307 A 7/1989 Tsao ..... 124/59
4,890,767 A 1/1990 Burlison ..... 222/78
4,897,065 A 1/1990 Fertig et al. ..... 446/63
4,928,661 A 5/1990 Bordt et al. ..... 124/61
4,955,512 A 9/1990 Sharples ..... 222/386.5
5,090,708 A 2/1992 Gerlitz et al. ..... 273/310
5,097,816 A * 3/1992 Miller
5,097,985 A 3/1992 Jones ..... 221/86
5,188,557 A 2/1993 Brown ..... 446/212
5,229,531 A 7/1993 Song ..... 42/58
5,280,778 A 1/1994 Kotsiopoulos ..... 124/73
5,280,917 A 1/1994 Ortiz ..... 273/318
5,335,579 A * 8/1994 David
5,339,791 A 8/1994 Sullivan ..... 124/73
5,343,849 A 9/1994 Steer ..... 124/72
5,343,850 A 9/1994 Steer ..... 124/64
5,349,938 A 9/1994 Farrell ..... 124/73
5,370,278 A 12/1994 Raynie ..... 222/175
5,373,832 A 12/1994 D'Andrade ..... 124/69
5,413,514 A 5/1995 Milligan ..... 446/36
5,415,152 A 5/1995 Adamson et al. ..... 124/59
5,450,839 A 9/1995 Nicolaevich et al. ..... 124/73
5,471,968 A 12/1995 Lee ..... 124/64
5,497,758 A 3/1996 Dobbins et al. ..... 124/73
5,515,837 A 5/1996 Nin et al. ..... 124/59
5,520,171 A * 5/1996 David
5,529,050 A 6/1996 D'Andrade ..... 124/56
5,553,598 A 9/1996 Johnson et al. ..... 124/63
5,605,140 A 2/1997 Griffin ..... 124/59
5,613,483 A 3/1997 Lukas et al. ..... 124/73
5,673,679 A 10/1997 Walters ..... 124/53.5
5,701,879 A 12/1997 Johnson et al. ..... 124/69
5,704,342 A 1/1998 Gibson et al. ..... 124/73
5,722,383 A 3/1998 Tippman, Sr. et al. ..... 124/76
5,749,797 A * 5/1998 Sunseri et al.
5,769,066 A 6/1998 Schneider ..... 124/75
5,771,875 A 6/1998 Sullivan ..... 124/72
5,794,606 A 8/1998 Deak ..... 124/51.1
5,816,232 A * 10/1998 Bell
5,878,734 A 3/1999 Johnson et al. ..... 124/59
5,887,578 A * 3/1999 Backeris et al.
6,109,252 A * 8/2000 Stevens

* cited by examiner

TOY GUN WITH MAGAZINE

TECHNICAL FIELD

This invention relates to toy guns, and specifically to toy guns having a magazine for firing a succession of projectiles.

BACKGROUND OF THE INVENTION

Toy guns which shoot or launch projectiles have been very popular for many years. These guns have been designed to launch projectiles in a number of ways. A common method of launching has been by the compression of a spring which propels the projectile upon its decompression or release, as, for example, with BB guns and dart guns. These guns however usually do not generate enough force to launch projectiles with great velocity.

Toy guns have also been designed which use compressed air to launch projectiles such as foam darts or balls. These types of guns use a reciprocating air pump to pressurize air within a pressure tank. In use, a single dart is loaded and the pump is typically reciprocated several times with each firing of the gun. Therefore, the gun must be loaded and pumped with each firing as it is not capable of firing several darts in rapid sequence. The rapid firing of a gun may be desired for those playing a mock war or other type of competition.

Today children who play mock wars often carry several guns at one time in order to fire several shots simultaneously or in rapid succession or carry a gun which is capable to firing several shots. Guns which may fire several shots in rapid succession typically include a magazine having multiple launch tubes each of which is adapted to hold a single projectile. However, once the gun is fired several times the child must reposition each projectile within the emptied launch tubes. This reloading of the launch tubes can be tedious and time consuming, an undesirable situation during a mock war wherein time is of the essence.

As such, it would be desirable to have a gun wherein a batch of projectiles may be gang loaded. When a projectile is made of a generally rigid material it is easy to move the projectile through the use of an indexing wheel, as shown in U.S. Pat. Nos. 5,097,985 and 5,816,232. However, the use of these indexing wheels with projectiles made of a soft, pliable material has proven to be difficult. The reason for the difficulty has arisen from the fact that these soft balls often get pinched between the blades of the indexing wheel and the surrounding structure, thereby causing a binding of the indexing wheel which renders the gun inoperable.

Accordingly, it is seen that a need remains for a toy gun which may be fire a succession of projectiles from a magazine which may be gang loaded. It is to the provision of such therefore that the present invention is primarily directed.

SUMMARY OF THE INVENTION

In a preferred form of the invention a toy gun adapted to launch a projectile comprises a launch tube having a breach adapted to receive a projectile and a hopper coupled to the breach. The hopper has an outer housing having an annular outer wall and a floor, a central hub, an annular inner housing mounted concentrically within the outer wall, and a plurality of divider walls extending between the central hub and the inner housing thereby defining a plurality of projectile cells having a bottom opening therein. The outer housing has an opening therein sized and shaped to allow the passage of projectiles therethrough. An indexer is coupled to the central hub. With this construction, the inner housing prevents contact of the projectile with the outer housing outer wall to prevent accidental binding of the projectile between the divider wall and the outer wall during indexing.

DETAILED DESCRIPTION

Figure 1:
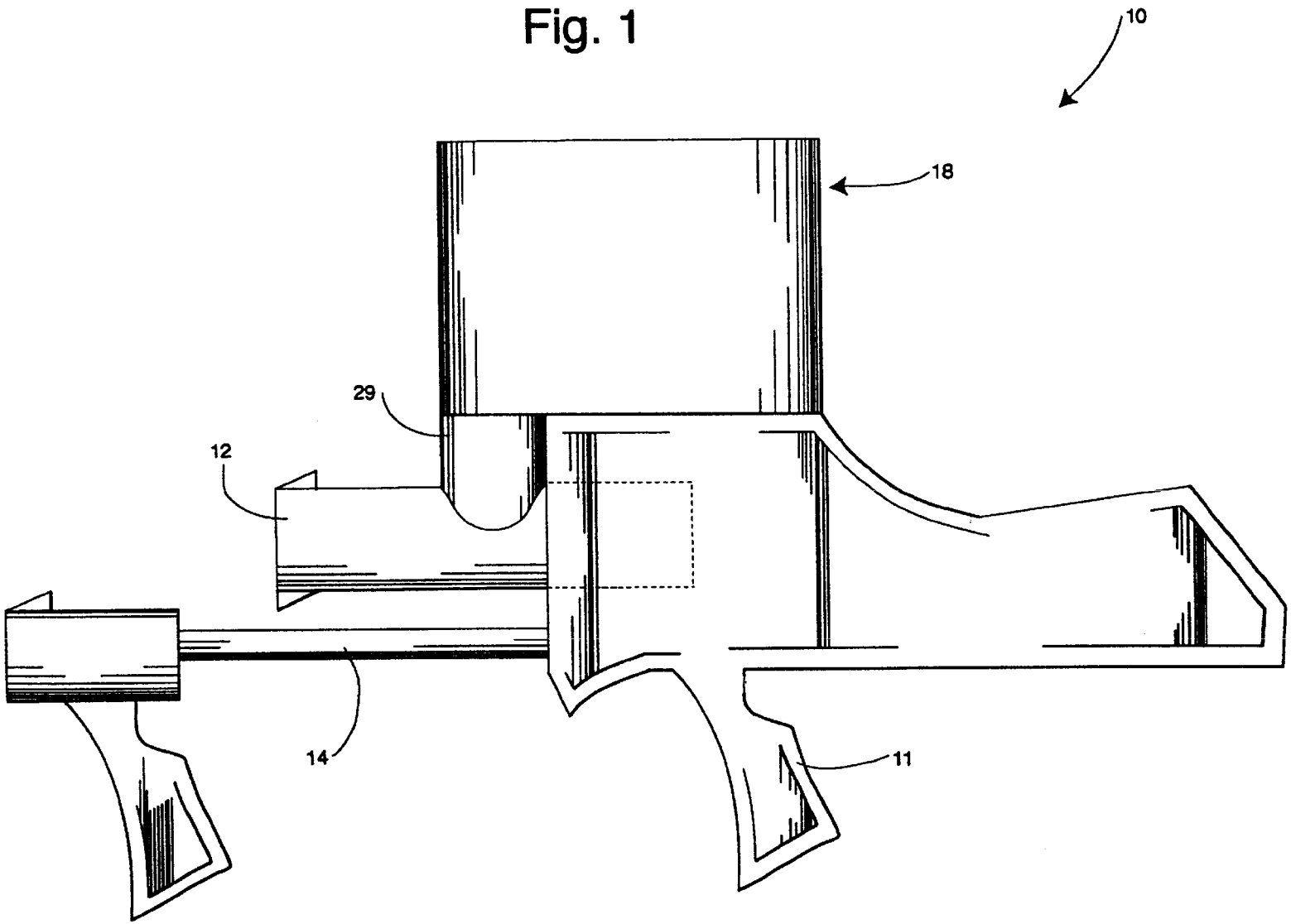
FIG. 1 is a side view of a compressed air gun embodying principles of the present invention in a preferred form.

With reference next to the drawings, there is shown a compressed air gun 10 having a stock or handle 11, a launch tube 12 reciprocally mounted to the stock 11, and a manual air pump 14. The gun 10 has a pressure chamber 15 positioned within the launch tube 13 and a release valve 16 mounted within the pressure chamber 15 in fluid communication with air pump 14 through a pressure tube 17. The gun also includes a multi-projectile hopper or magazine 18 mounted for rotational movement upon the stock 11.

Figure 4:
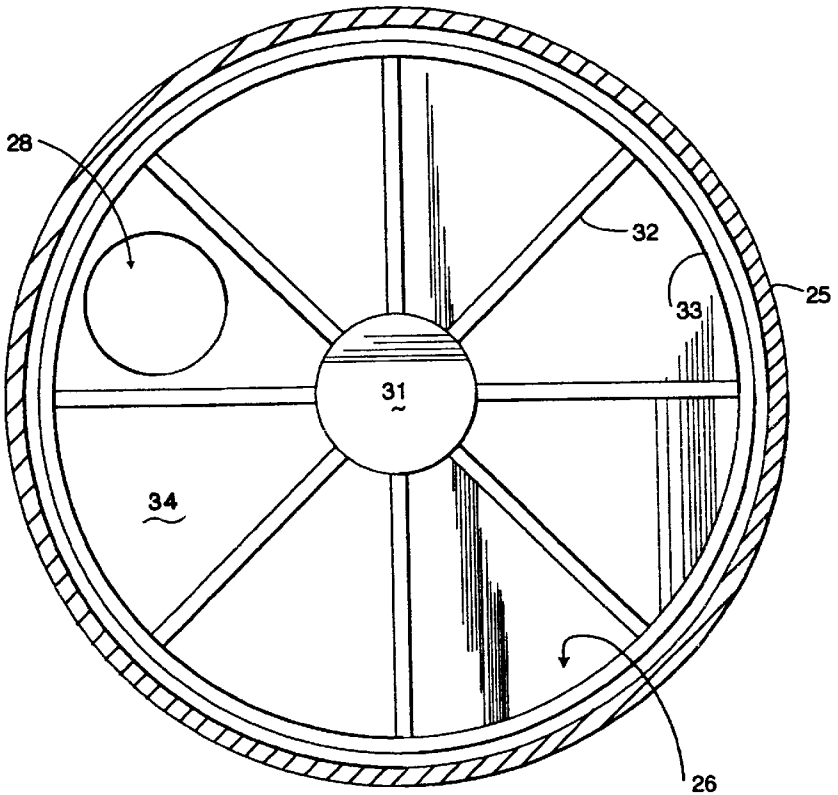
FIG. 4 is a top view of the magazine.
Figure 5:
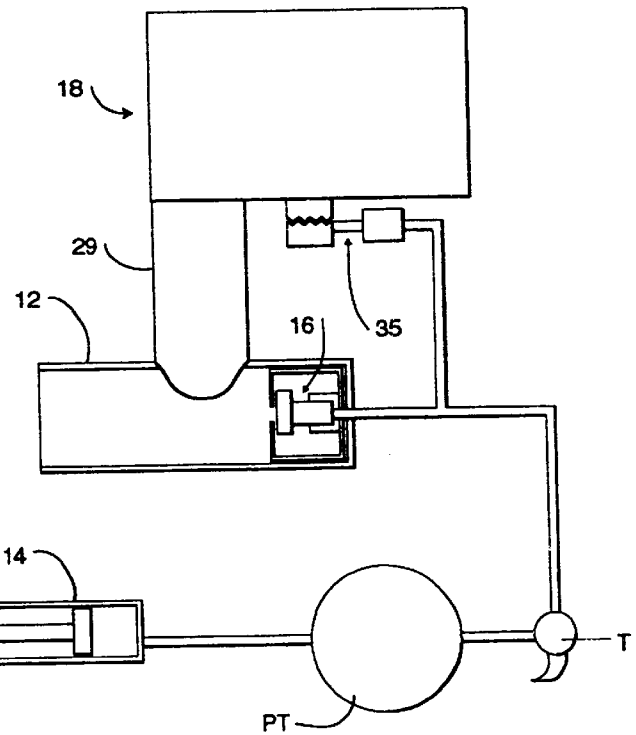
FIG. 5 is a schematic view of a compressed air gun in another preferred form of the invention.

The pump 14 includes a conventional cyliner 20, a cylinder rod 22 terminating at a sealing head 19, and a handle 22 mounted to an end of the cylinder rod 21. The handle 22 has a flange 23 projecting upwardly.

the magazine 18 has a cylindrical outer housing shell 25 and an internal indexing wheel 26 positioned within the outer shell 25, as best shown in FIG. 5. The outer shell 25 includes a pivotal lid 27 and a floor having a bottom opening 28 extending to a loading tube 29. The indexing wheel 26 has a central pivot hub 31 having an annular array of divider walls or find 32 extending therefrom coupled to a peripheral internal housing ring 33. The fins 32 and internal housing ring 33 extend along a majority of the height of the outer shell 25. The combination of the central hub 31, fins 32 and internal housing ring 33 defines an annular array of opened bottomed projectile cells 34, best shown in FIG. 4.

The central hub 31 is mounted to an indexer 35 having a rachet assembly 36 and sa pneumatic drive 37 coupled to pressure tube 17 through a pressure tube 38. The rachet assembly 36 has an angled toothed top plate 39 and an angled toothed bottom plate 40 sized and shaped to conform with top plate 39 and rotate relative to the bottom plate in only one direction. The botom plate 40 is coupled to pneumatic drive 37 and a coil spring 41 which biases the bottom plate in a direction opposite to the force of the pneumatic drive 37.

The pressure chamber 15 is fixedly mounted to the stock 11 and adapted to receive and store a supply of air at elevated pressure levels. The pressure chamber 15 has an exit opening 43 therein. The release valve 16 has a cylindrical manifold 45 and a cylindrical plunger 46 slidably mounted within manifold 45 in alignment with exit opening 43. Plunger 46 has a gasket 47 to ensure sealing engagement of the plunger 46 about exit opening 43. The pressure chamber 15 also includes an annular, O-ring type seal 48 which provides an air tight seal between the pressure chamber 15 and the interior of the launch tube 12. In this embodiment the front wall of the pressure chamber may be considered part of a "seal" which seals off the launch tube.

The launch tube 12 has a top opening 50 sized and shaped to allow the passage of projectiles therethrough and a forward, annular, O-ring type seal 52 fixedly mounted to the interior of the launch tube in a location spaced forward of opening 50. The launch tube 12, pressure chamber 15 and seal 52 define a firing chamber 55. The launch tube 12 also has slots therethrough through which extend portions of the pressure chamber and pressure tube 38 to allow unobstructed reciprocal movement of the launch tube as described in more detail hereinunder. A flange 54 sized and shaped to engage pump flange 23 depends from the front end of the launch tube 12. A spring 56 extends between the launch tube and the stock so as to bias the launch tube forwardly. The launch tube 12 is adapted for reciprocal movement between a loading position shown in FIG. 2 and a firing position shown in FIG. 3.

Figure 2:
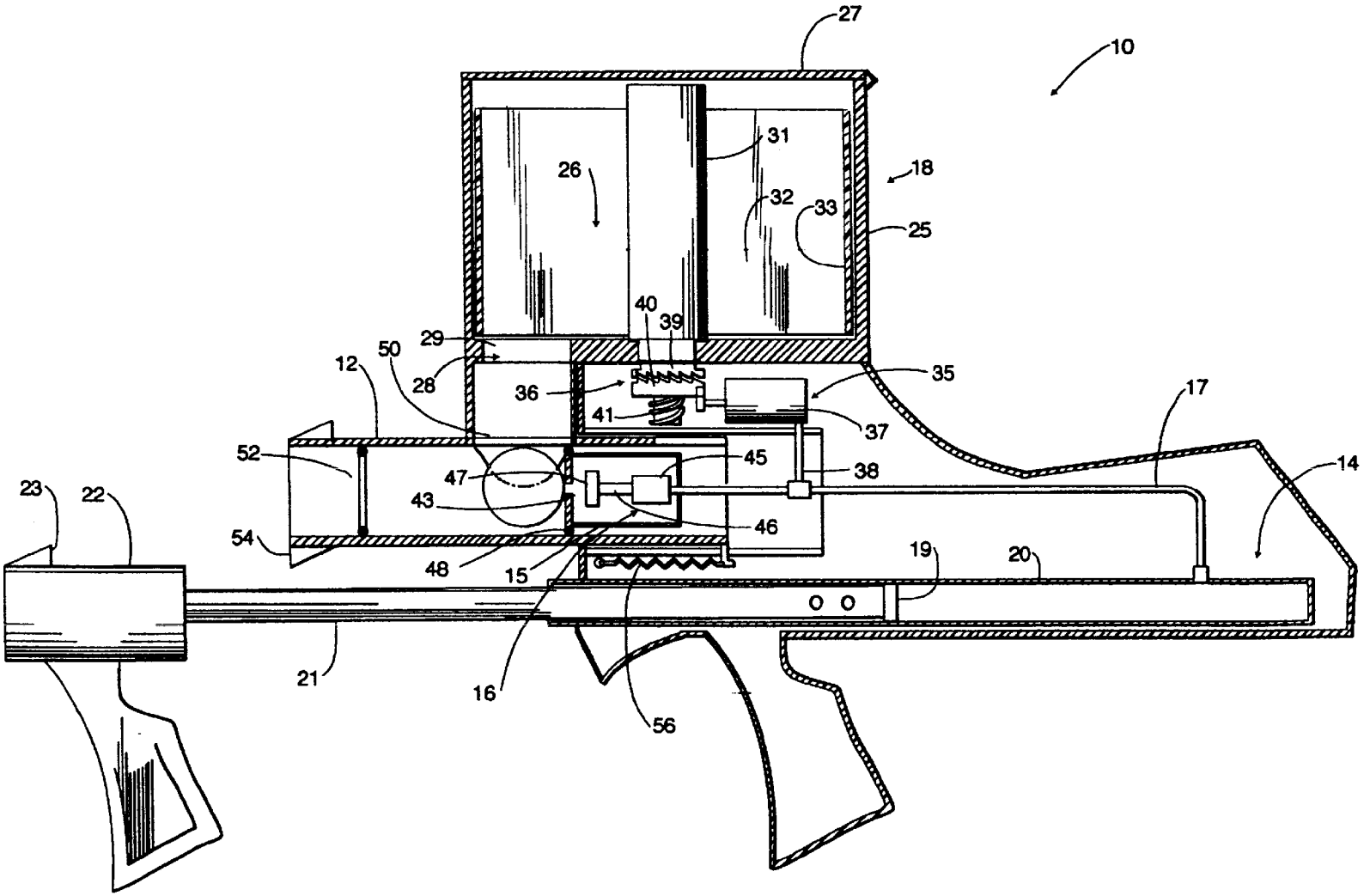
FIGS. 2 and 3 are a sequence of side views, shown in partial cross-section, showing a portion of the air gun of FIG. 1, which show in sequence, the actuation of the launch tube and pump.

In use, an operator actuates the pump to pressurize a supply of air by grasping the handle 22 and moving the cylinder rod 21 rearwardly within the cylinder 20. Pressurized air within the cylinder passes through pressure tube 17 into the manifold 45 of the release valve 16. The pressurized air within the release valve manifold 45 causes the plunger 46 to move to a forward position sealing the opening 43. Pressurized air then flows between the plunger 46 and the release valve manifold 45 so as to pressurize the pressure chamber 15. A portion of the pressurized air passing through pressure tube 17 is diverted into pressure tube 38 and conveyed into the pneumatic drive 37. With increased pressure within the pneumatic drive 37 the drive forces the rotation of the bottom plate 40, which engages and causes the rotation of the top plate 39 against the biasing force of coil spring 41. The movement of the top plate 39 in turn causes the rotation of the indexing wheel 26, thereby bringing the next projectile cell 34 into position so that a projectile P therein is aligned with the opening 28 in the bottom of the magazine 18. The projectile P drops downwardly through the opening 28, through the loading tube 29, and through the launch tube opening 50 so that the projectile P comes to rest within the launch tube 12, as shown in FIG. 2. It should be understood that the internal housing ring 33 moves along with the movement of the fins 32. As such a soft projectile is prevented from contacting the outer shell 25 as the indexing wheel 26 is rotated and thereby becoming jammed or bound between the fin and the outer shell. The height of the indexing wheel prevents the interlocking positioning of several projectiles or balls within the hopper, a problem that may prevent the rotation of the indexing wheel. All references herein to directions are for purposes of clarity in reference to the drawings.

Figure 3:
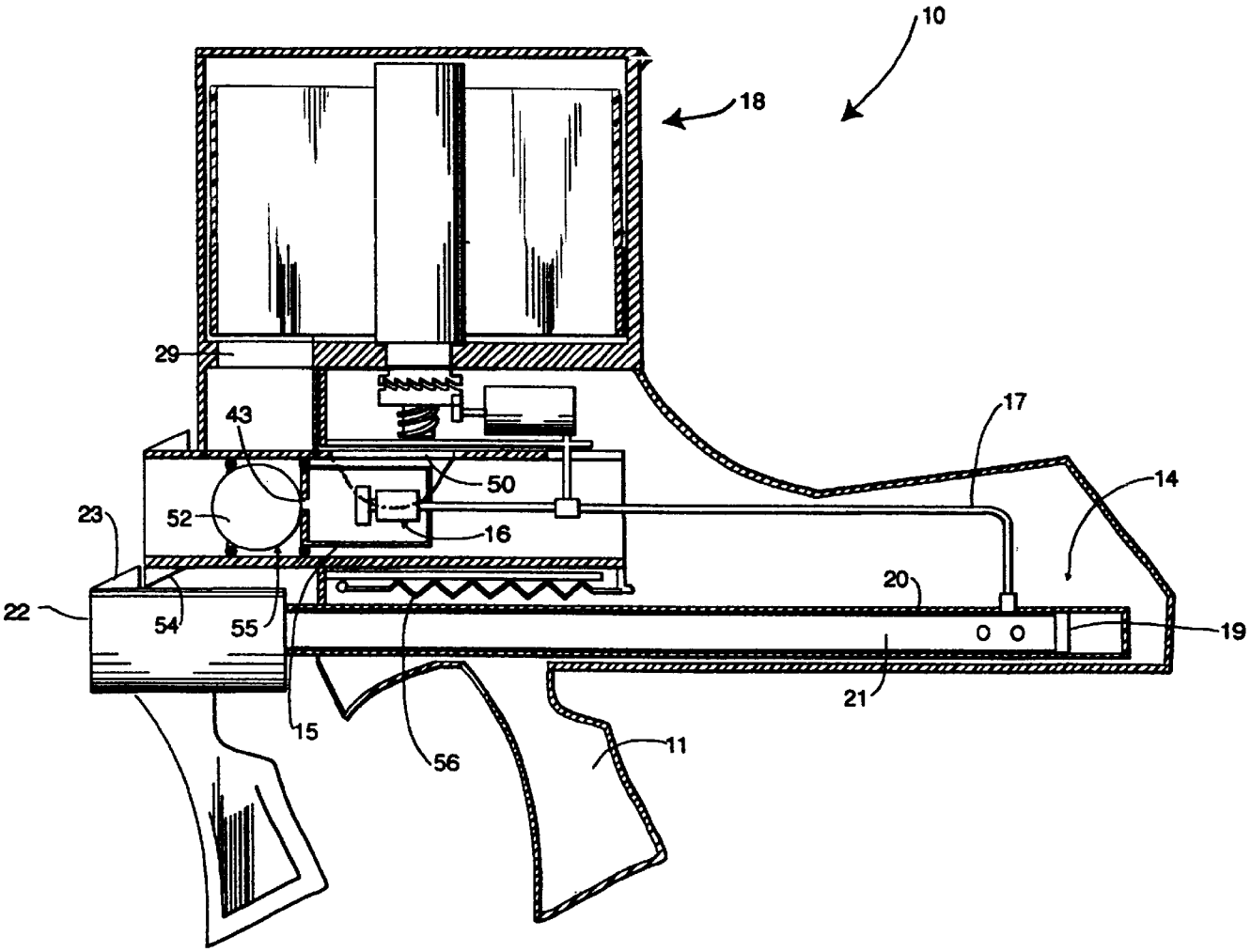

Continued movement of the pump handle 22 causes handle flange 23 to engage launch tube flange 54 and move the launch tube 12 from its loading position, shown in FIG. 2, to its firing position, shown in FIG. 3, against the biasing force of spring 56. This rearward movement of the launch tube causes the forward seal 52 is engage the projectile P. This movement also causes the launch tube opening 50 to be positioned behind the pressure chamber seal 48 so that with the projectile sealably engaging the forward seal the firing chamber 55 is sealed completely.

The final movement of the launch tube through the movement of the pump coincides with the maximum pressure of the pump, so that the passage of the pump sealing head 19 past the pump coupled to pressure tube 17 causes a release of air pressure within pressure tube 17 back into the pump cylinder. The release of air pressure causes the pressure valve plunger 46 to move to a rearward position unsealing opening 43. With the unsealing of opening 43 pressurized air within pressure chamber 15 flows through opening 43, into the firing chamber 55 of the launch tube. Pressurized air within launch tube propels the projectile P past the forward seal 52 and from the launch tube. The actuation of this type of release valve and air pump is described in more detail in U.S. Pat. No. 5,701,879 which is specifically incorporated herein.

Upon the release of pressurized air from pressure chamber 15 the pressurized air within pneumatic drive 37 is released through pressure tubes 38 and 17. The release of air from pneumatic drive 37 causes the bottom plate 40 to be rotatably spring biased by coil spring 41 back to its initial position. As such, the bottom plate is again registered with the top plate 39 so as to initiate the next indexing movement of the magazine wheel 26.

The return of the pump handle 22 to its initial, extended position, shown in FIG. 2, allows the spring biasing force of spring 56 to return the launch tube 12 to its initial, loading position.

It should be understood that the forward seal 52 causes enough resistance to insure not only a proper seal about the projectile but to delay momentarily the forward travel of the projectile so that there is a maximum build up of compressed air within the firing chamber of the launching tube. As such, as the projectile passes the forward seal there is a maximum force of air pressure within the launch tube to provide maximum distance of the projectile.

It should be understood that a pressure tank, alone or in addition to the air pump, may also be used to provide compressed air, as shown in FIG. 5. Such an arrangement is also described in detail in U.S. Pat. No. 5,787,869 and U.S. patent application Ser. No. 08/822,008, which are specifically incorporated herein. As such, a gun may utilize a pump, a pressure tank, or the combination of a pump and pressure tank to provide a supply of compressed air. It should also be understood that the term breach as used herein is meant to include any loading portion of a launch tube. Furthermore, it should also be understood that the indexing wheel may also be coupled to manual indexing means rather than the pneumatic indexing means shown in the preferred embodiments.

While this invention has been described in detail with particular reference to the preferred embodiments thereof, it should be understood that many modifications, additions and deletions, in addition to those expressly recited, may be made thereto without departure from the spirit and scope of invention as set forth in the following claims.

What is claimed is:

1. A toy gun adapted to launch a projectile comprising:

a launch tube having a breach adapted to receive a projectile;

a hopper in communication with said breach, said hopper having an outer housing having an annular outer wall and a floor, a central hub, an annular inner housing mounted concentrically within said outer wall, and a plurality of divider walls extending between said central hub and said inner housing thereby defining a plurality of projectile cells, each said projectile cell having a bottom opening therein, said outer housing having an opening therein sized and shaped to allow the passage of projectiles therethrough;

an indexer coupled to said central hub, whereby the inner housing prevents contact of the projectile with the outer housing outer wall to prevent accidental binding of the projectile between the divider wall and the outer wall during indexing.

2. The toy gun of claim 1 further comprising conduit means for conveying the projectile from said outer housing opening to said breach.

3. The toy gun of claim 1 wherein said outer wall has a selected height and wherein said inner housing extending along a majority of said selected height.

4. The toy gun of claim 1 wherein said outer housing also includes a lid coupled to said outer wall.

5. The toy gun of claim 1 further comprising means for pressurizing air and wherein said indexer is a pneumatic indexer in fluid communication with said means for pressurizing air.

6. The gun of claim 5 wherein said means for providing compressed air comprises an air pump.

7. The gun of claim 5 wherein said means for providing compressed air comprises a pressure tank.

8. The gun of claim 7 wherein said means for providing compressed air further comprises an air pump.

9. The toy gun of claim 1 wherein said outer housing opening extends through said outer housing floor.

10. A toy gun adapted to launch a projectile comprising:

a launch tube having a breach adapted to receive a projectile;

a hopper in communication with said breach, said hopper having an outer housing and an indexing wheel mounted within said outer housing;

said outer housing having an annular outer wall and a floor having an opening sized and shaped to allow the passage of projectiles therethrough;

said indexing wheel having a central hub, a peripheral wall mounted concentrically within said outer wall, and a plurality of divider walls extending between said central hub and said peripheral wall thereby defining a plurality of projectile cells, each said projectile cell having a bottom opening therein;

an indexer coupled to said indexing wheel, whereby the indexing wheel peripheral wall prevents contact of the projectile with the outer housing outer wall to prevent accidental binding of the projectile between the divider wall and the outer wall during indexing.

11. The toy gun of claim 10 further comprising conduit means for conveying the projectile from said outer housing opening to said breach.

12. The toy gun of claim 10 wherein said outer wall has a selected height and wherein said inner housing extending along a majority of said selected height.

13. The toy gun of claim 10 wherein said outer housing also includes a lid coupled to said outer wall.

14. The toy gun of claim 10 further comprising means for pressurizing air and wherein said indexer is a pneumatic indexer in fluid communication with said means for pressurizing air.

15. The gun of claim 14 wherein said means for providing compressed air comprises an air pump.

16. The gun of claim 14 wherein said means for providing compressed air comprises a pressure tank.

17. The gun of claim 16 wherein said means for providing compressed air further comprises an air pump.

18. The toy gun of claim 10 wherein said outer housing opening extends through said outer housing floor.

* * * * *